US008915271B2

(12) United States Patent
Liu

(10) Patent No.: US 8,915,271 B2
(45) Date of Patent: Dec. 23, 2014

(54) SYSTEM AND METHOD FOR FLUIDS TRANSFER BETWEEN SHIP AND STORAGE TANK

(71) Applicant: Xuejie Liu, Houston, TX (US)

(72) Inventor: Xuejie Liu, Houston, TX (US)

( * ) Notice: Subject to any disclaimer, the term of this patent is extended or adjusted under 35 U.S.C. 154(b) by 42 days.

(21) Appl. No.: 13/712,786

(22) Filed: Dec. 12, 2012

(65) Prior Publication Data

US 2013/0153083 A1 Jun. 20, 2013

Related U.S. Application Data

(60) Provisional application No. 61/578,225, filed on Dec. 20, 2011.

(51) Int. Cl.

| | |
|---|---|
| ***B65B 1/04*** | (2006.01) |
| ***B63B 27/24*** | (2006.01) |
| ***B67D 9/00*** | (2010.01) |

(52) U.S. Cl.

CPC .. *B63B 27/24* (2013.01); *B67D 9/00* (2013.01)

USPC ..... 141/382; 141/1; 141/279; 141/383; 141/384; 141/387; 441/4; 441/5

(58) Field of Classification Search

CPC ..... B63B 27/24; B67D 9/02

USPC ..... 141/1, 231, 279, 363, 382–384, 387, 141/388; 137/236.1, 615; 441/4, 5

See application file for complete search history.

(56) References Cited

U.S. PATENT DOCUMENTS

| | | | | | |
|---|---|---|---|---|---|
| 2,771,617 | A | * | 11/1956 | Brackx | 441/4 |
| 2,818,891 | A | * | 1/1958 | Loeser | 141/388 |
| 2,914,080 | A | * | 11/1959 | Silveston | 137/236.1 |
| 3,305,106 | A | * | 2/1967 | Ishino | 406/49 |
| RE26,351 | E | * | 2/1968 | Sheiry | 137/615 |
| 3,379,027 | A | | 4/1968 | Mowell et al. | |
| 3,434,491 | A | | 3/1969 | Bily | |
| 3,494,387 | A | * | 2/1970 | Grigg et al. | 141/40 |
| 3,596,674 | A | * | 8/1971 | Takizawa et al. | 137/94 |
| 3,620,268 | A | * | 11/1971 | Paddington et al. | 141/388 |
| 3,774,253 | A | * | 11/1973 | Lecomte | 441/4 |
| 3,921,557 | A | * | 11/1975 | Kapteijn et al. | 114/256 |
| 3,921,684 | A | * | 11/1975 | Allen | 141/279 |
| 4,121,616 | A | * | 10/1978 | Lochte et al. | 137/615 |
| 4,173,804 | A | * | 11/1979 | Duc | 441/4 |
| 4,190,090 | A | * | 2/1980 | Tuson | 141/387 |

(Continued)

FOREIGN PATENT DOCUMENTS

GB 1462358 EP 1/2006

*Primary Examiner* — Timothy L Maust

(57) ABSTRACT

The present invention provides a system and a method for loading/unloading cryogenic fluids between a ship and storage tanks The system comprises a shaft extended upwards to above the sea level, a transfer pipeline extended from the storage tanks to the shaft with a free end free to expand/contract axially inside the shaft, a header fluidly connected to the free end, at least one downward pipe branch from the header, at least one hose coupler attached to the shaft, at least one internal hose freely hung inside the shaft between the downward pipe branch and the hose coupler, and at least one loading arm fluidly connected to the hose coupler and having an end flange for connection with ship manifolds for fluid transfer. The system further comprises at least one vertical support to support the header in the vertical direction, wherein the header is free to move along with the free end of the transfer pipeline.

30 Claims, 10 Drawing Sheets

(56) References Cited

U.S. PATENT DOCUMENTS

| | | | | |
|---|---|---|---|---|
| 4,206,782 | A * | 6/1980 | Tuson | 137/615 |
| 4,273,066 | A * | 6/1981 | Anderson | 114/256 |
| 4,317,474 | A * | 3/1982 | Kentosh | 141/1 |
| 4,826,354 | A * | 5/1989 | Adorjan | 405/158 |
| 6,886,611 | B2 | 5/2005 | Dupont et al. | |
| 6,932,127 | B2 * | 8/2005 | Samuelsen et al. | 141/387 |
| 6,973,948 | B2 * | 12/2005 | Pollack et al. | 141/387 |
| 6,979,147 | B1 * | 12/2005 | Wille et al. | 405/8 |
| 6,994,506 | B2 * | 2/2006 | de Baan | 414/139.4 |
| 6,997,643 | B2 * | 2/2006 | Wille et al. | 405/53 |
| 7,029,348 | B2 * | 4/2006 | Bauduin et al. | 441/4 |
| 7,080,673 | B2 * | 7/2006 | Pollack et al. | 141/387 |
| 7,147,021 | B2 | 12/2006 | Dupont et al. | |
| 7,174,931 | B2 * | 2/2007 | Espinasse | 141/387 |
| 7,299,835 | B2 | 11/2007 | Dupont et al. | |
| 7,438,617 | B2 | 10/2008 | Poldervaart et al. | |
| 7,836,840 | B2 | 11/2010 | Ehrhardt et al. | |
| 7,857,001 | B2 | 12/2010 | Kristensen et al. | |
| 8,152,580 | B2 * | 4/2012 | Straume et al. | 441/4 |
| 8,176,938 | B2 | 5/2012 | Queau et al. | |
| 8,181,662 | B2 | 5/2012 | Pollack et al. | |
| 8,286,678 | B2 * | 10/2012 | Adkins et al. | 141/387 |
| 8,539,970 | B2 * | 9/2013 | Thomas et al. | 137/15.08 |
| 8,622,099 | B2 * | 1/2014 | Liem et al. | 141/59 |
| 2004/0086345 | A1 * | 5/2004 | Snowdon | 406/198 |
| 2005/0051237 | A1 * | 3/2005 | Dupont et al. | 141/384 |
| 2008/0011357 | A1 * | 1/2008 | Wille et al. | 137/234.6 |
| 2009/0272459 | A1 * | 11/2009 | Biaggi | 141/1 |
| 2010/0287957 | A1 | 11/2010 | Liu | |
| 2012/0037265 | A1 * | 2/2012 | Bodanese et al. | 141/1 |
| 2012/0067434 | A1 * | 3/2012 | Foo et al. | 137/15.01 |
| 2013/0109258 | A1 * | 5/2013 | Coombs et al. | 441/5 |
| 2013/0240085 | A1 * | 9/2013 | Hallot et al. | 141/311 R |

* cited by examiner

SYSTEM AND METHOD FOR FLUIDS TRANSFER BETWEEN SHIP AND STORAGE TANK

CROSS-REFERENCE TO RELATED APPLICATIONS

This application claims priority of U.S. Provisional patent application Ser. No. 61/578,225 filed on Dec. 20, 2011.

U.S. PATENT DOCUMENTS

| | | | |
|---|---|---|---|
| 3,379,027 | April 1968 | Mowell | 62/53 |
| 3,434,491 | March 1969 | Bily | 137/315 |
| 4,417,603 | November 1983 | Argy | 138/149 |
| 6,886,611 | May 2005 | Dupont and Paquet | 141/279 |
| 7,147,021 | December 2006 | Dupont and Paquet | 141/382 |
| 7,147,022 | December 2006 | Devehat | 141/387 |
| 7,299,835 | November 2007 | Dupont et al | 141/382 |
| 7,438,617 | October 2008 | Poldervaart et al | 441/5 |
| 7,836,840 | November 2010 | Ehrhardt et al | 114/230 |
| 7,857,001 | December 2010 | Kristensen | 137/615 |
| 8,176,938 | May 2012 | Queau and Maurel | 137/615 |
| 8,181,662 | May 2012 | Pollack et al | 137/15 |
| 8,286,678 | October 2012 | Adkins et al | 141/387 |
| 2010/0287957 | November 2010 | Liu | |

FOREIGN PATENT DOCUMENTS

| | | | |
|---|---|---|---|
| EP 1,462,358 | May 2006 | B63B 27/30 | F17C 6/00 |

STATEMENT REGARDING FEDERALLY SPONSORED RESEARCH OR DEVELOPMENT

Not Applicable

BACKGROUND OF THE INVENTION

1. Field of Invention

The present invention relates generally to loading/unloading cryogenic fluids between a ship and storage tanks Specifically, the present invention provides a loading system that extends from a free end of a transfer pipeline to a ship manifold.

2. Description of the Related Art

Typical LNG terminals have storage tanks onshore and a transfer system extending from the storage tanks to a loading/unloading platform where a ship is docked. The loading platform is located on a coast, a river bank, or offshore. At most terminals the transfer pipelines are supported on trestles (i.e., above the sea level), and terminate at a loading header on a loading platform. Articulated loading arms extend from the loading header to a ship manifold for fluid transfer.

In these conventional systems, the transfer pipelines are fixed at the platform with expansion loops or bellows to accommodate temperature changes, and articulated loading arms accommodate ship motions. These conventional hard arms are made of rigid pipe and swivel joints. They are mounted on a supporting structure/ frame with balancing weight to extend arms toward a ship manifold as disclosed in U.S. Pat. No. 3,434,491 to Bily.

Some improvements have been developed for the hard arms. For example, U.S. Pat. No. 7,857,001 to Kristensen et al discloses a loading system with a spiral and rigid pipe attached to a boom with trolleys to compensate longitudinal movements. U.S. Pat. No. 8,176,938 to Queau and Maurel discloses a loading system with a movable supporting frame that allows end displacements of a transfer pipeline. U.S. Pat. No. 8,181,662 to Pollack et al discloses a loading system with a supporting metal shaft pivotable at its base. Regardless of these improvements, all the systems above have the followings in common: rigid pipes and a number of swivel joints, and a large supporting structure. These arms are not only costly, but also require maintenance with leakage potential from the swivel joints.

At a few terminals where LNG transfer pipelines are inside an underground tunnel, a vertical shaft is used at a loading station near the ship to host a rigid riser and support a loading header on the top. The rigid riser extends from the transfer line below to the loading header above. The same hard arms discussed above are then fluidly connected to the loading header. US2010/0287957 to Liu discloses a similar transfer system with a vertical shaft and a rigid riser inside. The difference is that the Liu's system allows end displacements of a transfer pipeline. However, stresses could develop at rigid riser ends under thermal expansion/contraction of the subsea transfer pipeline.

Flexible hoses for cryogenic fluids have been developed. These cryogenic hoses typically consist of multiple layers of polyester fabric and polymeric film as well as inner and outer spiral wound stainless steel wires as disclosed in U.S. Pat. No. 4,417,603 to Argy. Flexible hoses have been disclosed as loading arms for example in U.S. Pat. No. 8,286,678 to Adkins et al, and used for ship to ship transfer of cryogenic fluids by Excelerate Energy.

For ship-to-shore transfer, several systems have been proposed using flexible hoses. U.S. Pat. No. 6,886,611 to Dupont and Paquet discloses a loading system between a LNG ship and a termination point of a transfer pipeline that is fixed on a gantry above a main platform. The loading system comprises flexible loading arm(s) with one end permanently hung at the termination point and a free end hung under another gantry with a winch and cable near a LNG ship. During a loading operation, a connection module is lifted over with a crane and tied in with a ship manifold (first connection). The free end of the flexible arm is then pulled over with another winch and cable, and fluidly connected with the connection module (second connection). This system avoids swivel joints, and provides a mean to break a free fall of the flexible arm in case of emergency. However, the system cannot accommodate end displacements of a transfer pipeline. Moreover, the system doubles the number of flange connection/disconnection for each loading arm that is time-consuming.

U.S. Pat. No. 7,299,835 to Dupont et al discloses a flexible loading system comprising flexible hoses with one end hung at a reel attached to a station and another end extended to a ship manifold. The flexible hoses can be stored by rotating the reel after loading operations. Again, swivel joints are needed at the reel axis or at the rotatable connection.

A single point mooring system has also been proposed for subsea LNG transfer. The system comprises a cryogenic riser connecting subsea pipelines and a turret or the like, and loading arm(s) extended from the turret to a LNG ship. For example, U.S. Pat. No. 7,438,617 to Poldervaart et al discloses a system comprising a floating buoy, turntable reel as well as rotatable connection between flexible hoses and transfer risers. U.S. Pat. No. 7,836,840 to Ehrhardt et al discloses a system comprising a floating buoy, a flexible riser and a flexible arm with a submersible turret (i.e., rotatable) connection between the flexible arm end and socket at the ship bottom.

Other systems have a vertical post anchored at the seabed. U.S. Pat. No. 3,379,027 to Mowell discloses a fixed tower, a rigid riser, a rigid loading arm partially submerged in water. U.S. Pat. No. 7,147,021 to Dupont and Paquet discloses a system that has a riser attached to a vertical post with a rotatable connection, and piping along the boom that extends from the riser to a LNG ship. EP 1462358 to De Baan uses a vertical post as a riser, and flexible arms extend from the riser top to a ship for fluid transfer.

The drawback of these systems is the need for rotatable connection at an end of a loading arm as well as the difficulty to access underwater components.

In summary, there is a need to develop a loading system that not only allows end displacements of a transfer pipeline, but also overcomes the drawbacks discussed above.

BRIEF SUMMARY OF THE INVENTION

The present invention provides a loading/unloading system for cryogenic fluids between storage tanks and a ship. The system comprises a shaft extended upwards to above the sea level, a transfer pipeline extended from the storage tanks to the shaft and ended inside the shaft with a header, movable pipe hangers to hang the pipes inside the shaft so that the transfer pipeline is free to expand/contract axially, an internal hose freely hung between the header and a hose coupler, and a loading arm extended from the hose coupler to ship manifolds for fluid transfer. The loading arm further comprises an end flange at its mobile end that is movable to accommodate ship motions during transfer periods.

Accordingly, it is a principal object of the invention to provide a flexible but robust loading/unloading system that can accommodate both the ship motions and thermal expansion/contraction of a transfer pipeline.

It is another object of the invention to provide a loading system that is applicable for cryogenic fluids with pipe end displacements to release thermal stresses.

It is another object of the invention to protect a loading system from environmental impacts (e.g., corrosive sea-water, ocean wave, wind, and sunlight).

It is another object of the invention to provide easy access for equipment that is below the sea level around a loading platform. It is another object of the invention to provide a loading system applicable for a ship docked at a water front or offshore.

BRIEF DESCRIPTION OF THE DRAWINGS

The loading system, method and advantages of the present invention will be better understood by referring to the drawings, in which.

DETAILED DESCRIPTION OF THE PREFERRED EMBODIMENT

Figure 1:
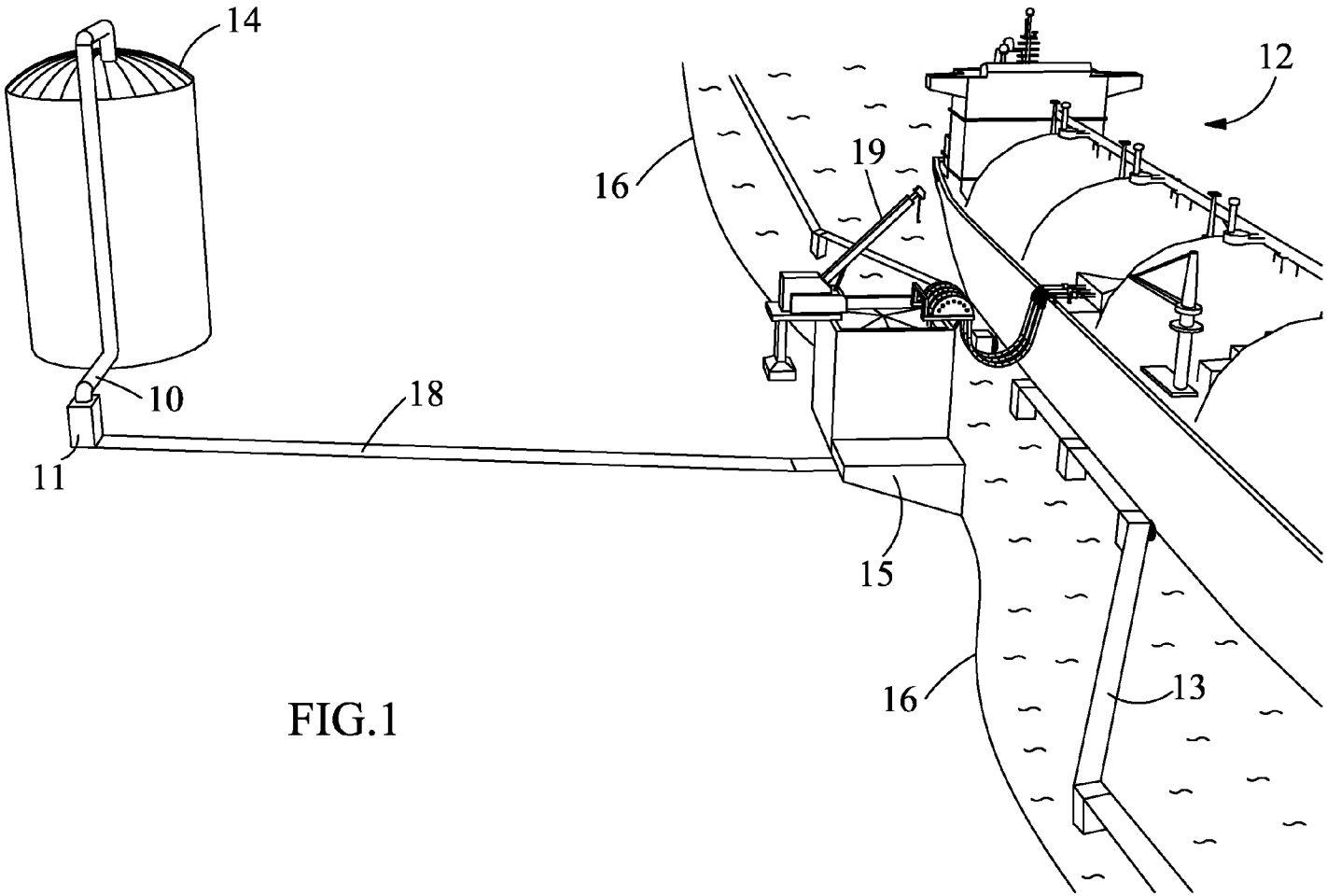
FIG. 1 is a perspective view of a first embodiment of the system along with other components at a loading /unloading terminal.

FIG. 1 is an overview of a first embodiment of the present invention at a loading or unloading (i.e., receiving) terminal. A ship 12 is docked at a dolphin 13, and a shaft 15 is located around a coast line 16. A transfer pipeline 10 extends from onshore tanks 14 to the shaft 15 with an anchor at a vault 11, and is encased with an underground reinforced concrete conduit 18. A crane 19 is located at the top of the shaft 15.

Figure 2:
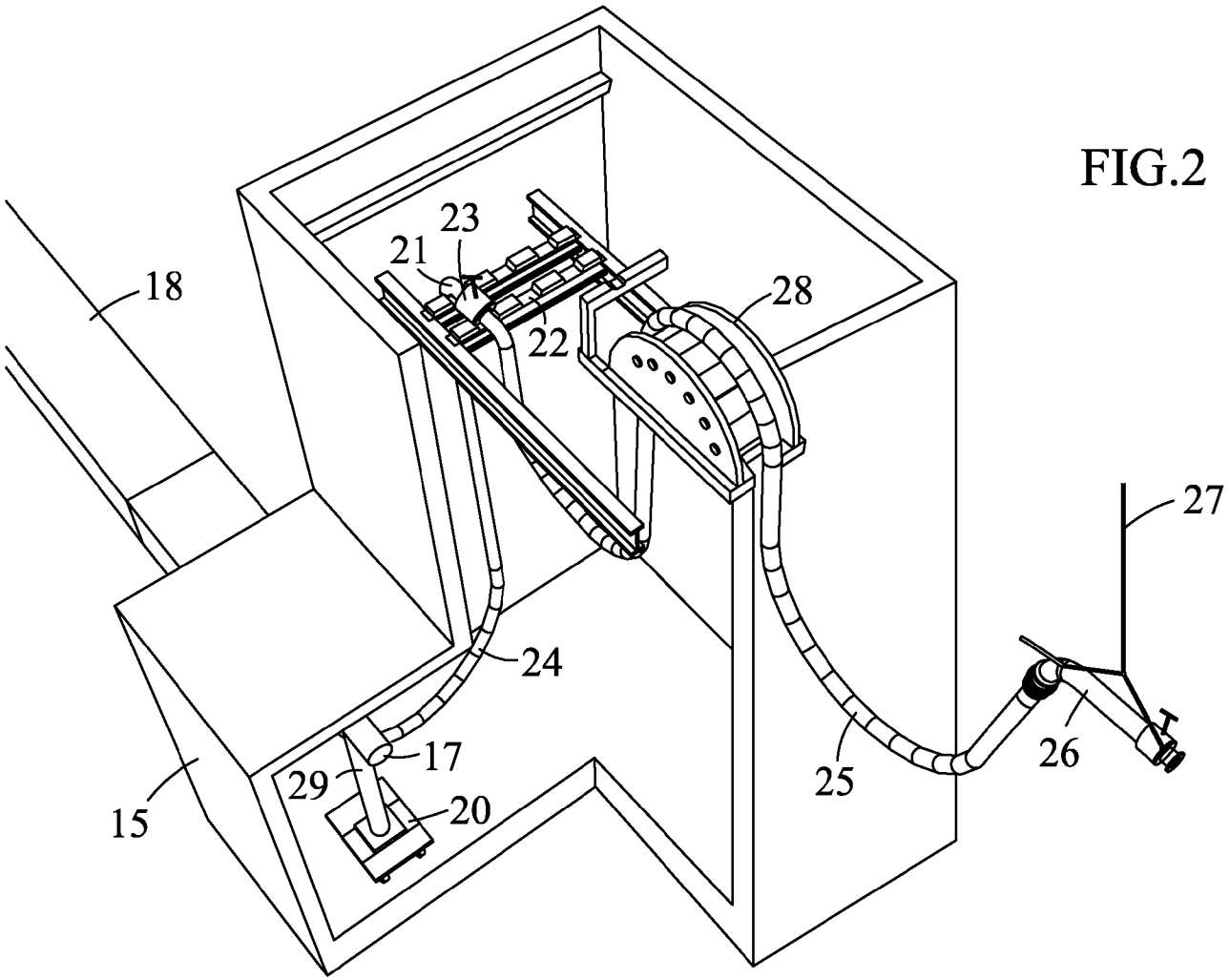
FIG. 2 is a perspective view of the first embodiment.

FIG. 2 shows a perspective view of this embodiment. A transfer pipeline enters the shaft 15 and ends with a header 17. A dolly 20 and a vertical bar 29 support header 17. A n-shaped hose coupler 21 is supported on a beam 22 inside shaft 15 with two openings facing down and a valve 23 in the middle. An internal hose 24 is fluidly connected with header 17 at the low end and freely hung from the hose coupler 21 at the high end. A flexible arm 25 is fluidly connected with the hose coupler 21 at one end, and lifted at a mobile end 26 with a chain 27 of a crane (refer to 19 in FIG. 1). A convex saddle 28 is anchored to a wall of the shaft 15 providing a convex surface for the flexible arm 25. In this embodiment, the internal hose 24 and flexible arm 25 are freely hung in two planes perpendicular to each other.

Figure 3:
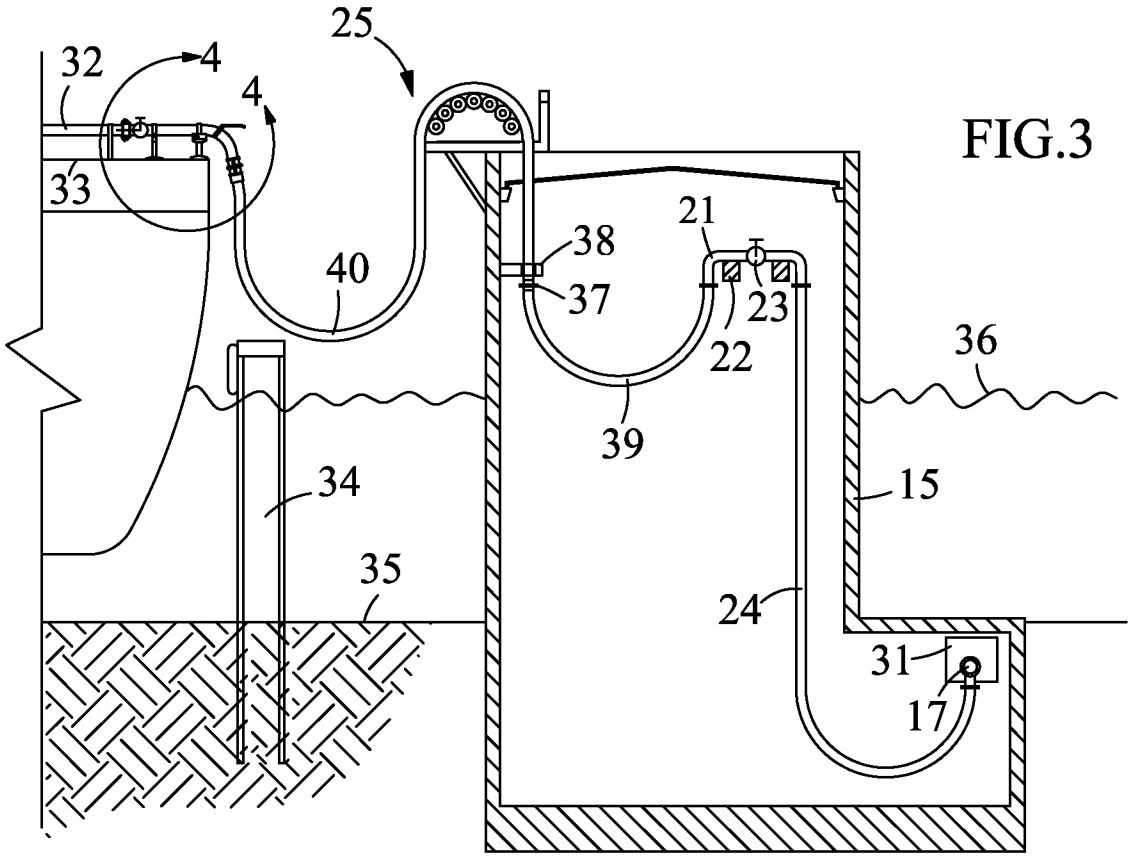
FIG. 3 is an elevation view of a second embodiment of the system in a loading position.

FIG. 3 shows a second embodiment while an internal hose 24 and flexible arm 25 are freely hung in two planes parallel to each other. A transfer pipeline enters the shaft 15 at an entrance 31 and ends with a header 17. The internal hose 24 is fluidly connected with the header 17 at the low end and freely hung from a n-shaped hose coupler 21 at the high end. The flexible arm 25 comprises a second internal hose 39 and external hose 40 extending from the hose coupler 21 to a ship manifold 32 on a ship platform 33. Both a dolphin 34 and shaft 15 are anchored to a seabed 35, and extends upwards to above the sea level 36. Between the second internal hose 39 and external hose 40, there is a stop flange 37 that is not allowed to pass through a restraining device 38 so that the internal hose 39 is not bent excessively. In this embodiment, the internal hose 24 and flexible arm 25 can be freely hung in two planes with an intersectional angle varying from 0 to 90 degree to fit a site condition.

Figure 4:
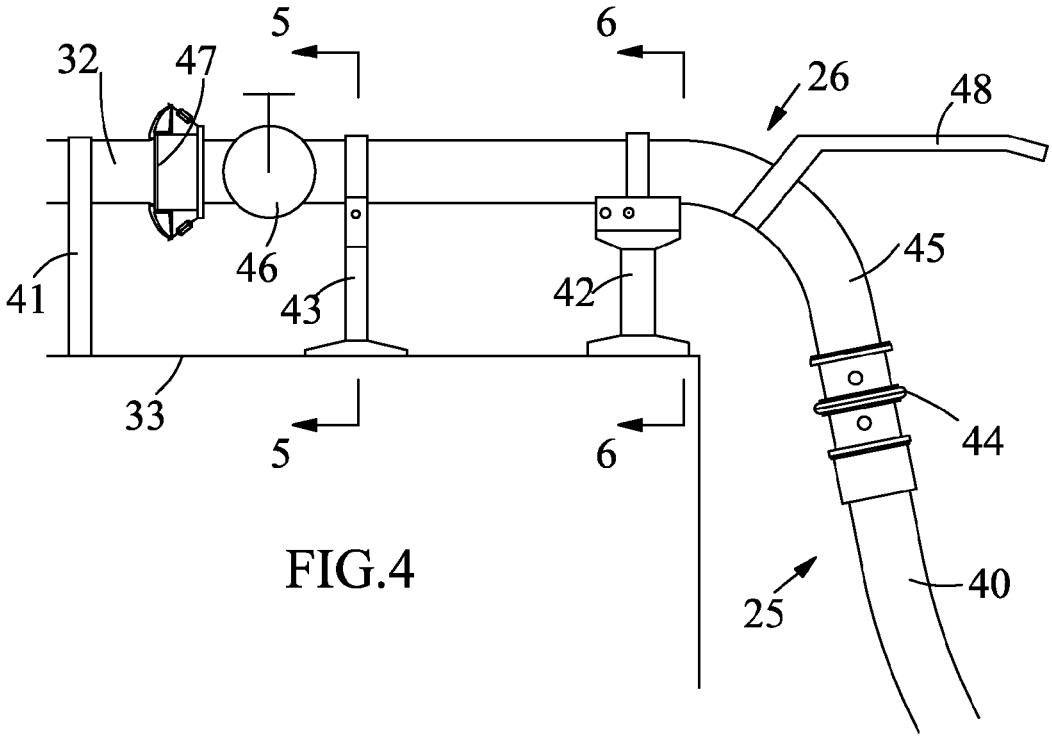
FIG. 4 is an enlarged view taken along 4-4 line in FIG. 3.

FIG. 4 shows details for connection at a ship manifold during loading operations. The ship manifold 32 is supported on the ship platform 33 with a stand 41. The mobile end 26 of the flexible arm 25 sits on the manifold platform 33 with a main leg 42 and an assistant leg 43. The mobile end 26 comprises a powered emergency release coupler (PERC) 44, an elbow spool 45 (i.e., a bend in this case), an end valve 46, and an end flange 47. The mobile end 26 is fluidly connected with the ship manifold 32 at one end and with an external hose 40 at the other end below. At the elbow spool 45, there is a handle 48. Alternatively, a two-way splitter can be fluidly connected with the elbow spool 45 and a smaller-size hose can be fluidly connected with each way of the two-way splitter (e.g., two 10-inch size hoses can replace a 16-in hose for a 16-in size manifold flange). Using a smaller size of hoses can reduce the size of the convex saddle 28 and shaft 15 shown in FIG. 3.

Figure 5:
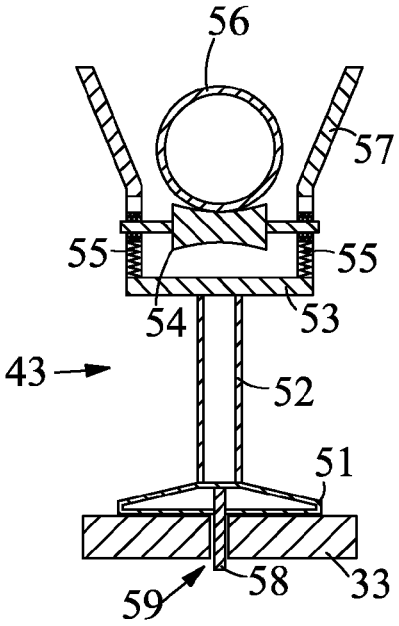
FIG. 5 is a sectional view taken along 5-5 line in FIG. 4.

FIG. 5 shows a cross-section view from line 5-5 in FIG. 4. The assistant leg 43 has a bottom plate 51, a column 52, and a top plate 53. A roller 54 is supported with springs 55 at both ends. A pipe 56 sits on the roller 54 and two alignment guides 57 extend upward with a widen opening. At the bottom, a male bar 58 is inserted into a hole 59 in the manifold platform 33.

Figure 6:
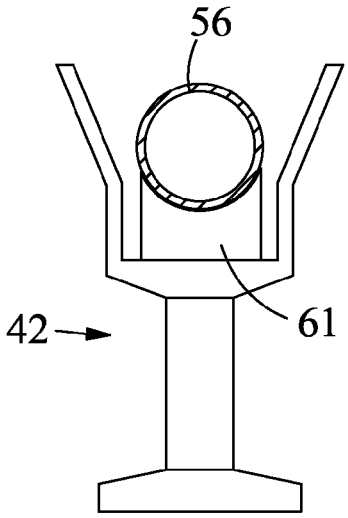
FIG. 6 is a sectional view taken along 6-6 line in FIG. 4.

FIG. 6 shows a cross-section view of the main leg 42 along line 6-6 in FIG. 4. The pipe 56 sits on a concave saddle 61. Alternatively, the main leg 42 has a combination of a roller (54 in FIG. 5 ) and concave saddle (61 in FIG. 6) sharing weight of the pipe 56 above. The height of both legs can be made adjustable with means such as leveling pins, rotating a threaded column, hydraulic jacking, etc. Those means are not shown for simplicity.

Figure 7:
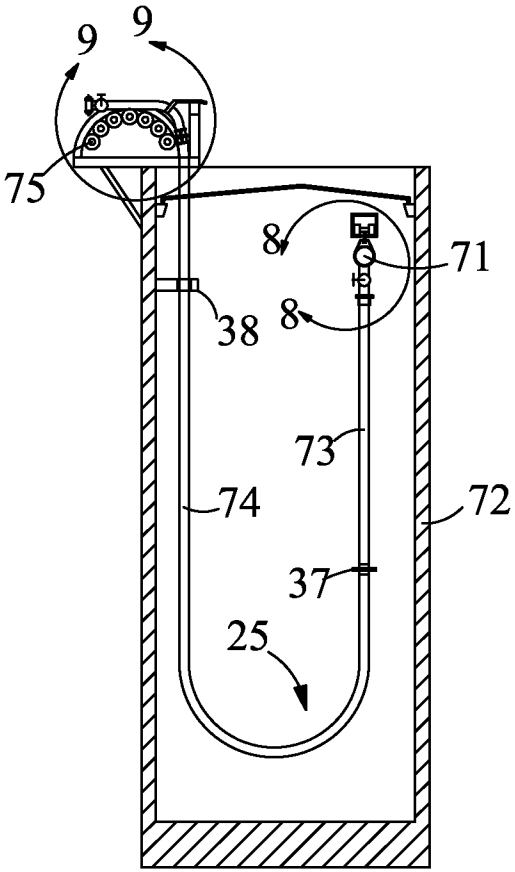
FIG. 7 is an elevation view of a third embodiment of the system in a stored position.

FIG. 7 shows an elevation view of a third embodiment with the flexible arm 25 in a stored position. A transfer pipeline enters a shaft 72 near the top and ends with a header 71. An internal hose 73 is hung below the header 71 at one end with another end fluidly connected to an external hose 74 (i.e., the flexible arm 25). A convex saddle 75 is located on the top of the shaft 72 across a side wall. Between the internal hose 73 and external hose 74, there is a stop flange 37 that is not allowed to pass through a restraining device 38 during fluid transfer. In this stored position, both internal and external hoses are stored inside the shaft 72, and protected from sea-water, wind and sunlight.

Figure 8:
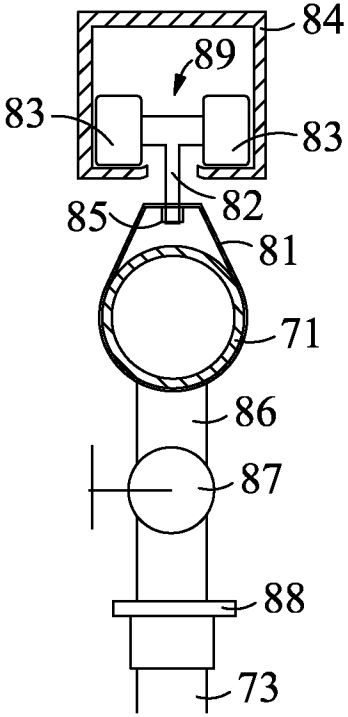
FIG. 8 is an enlarged view taken along 8-8 line in FIG. 7.

FIG. 8 shows details around the hanging off point inside the shaft along line 8-8 in FIG. 7. The header 71 is hung below a dolly 89 with a pipe hange comprising a clamp 81, vertical bar 82 and a nut 85. The dolly 89 has at least two wheels 83 rolling along a metal track 84 (for example a box beam) that is Anchored to the shaft 72. Below the header 71, there are a downward pipe branch 86, a branch valve 87, a flange connection 88 and an internal hose 73.

Figure 9:
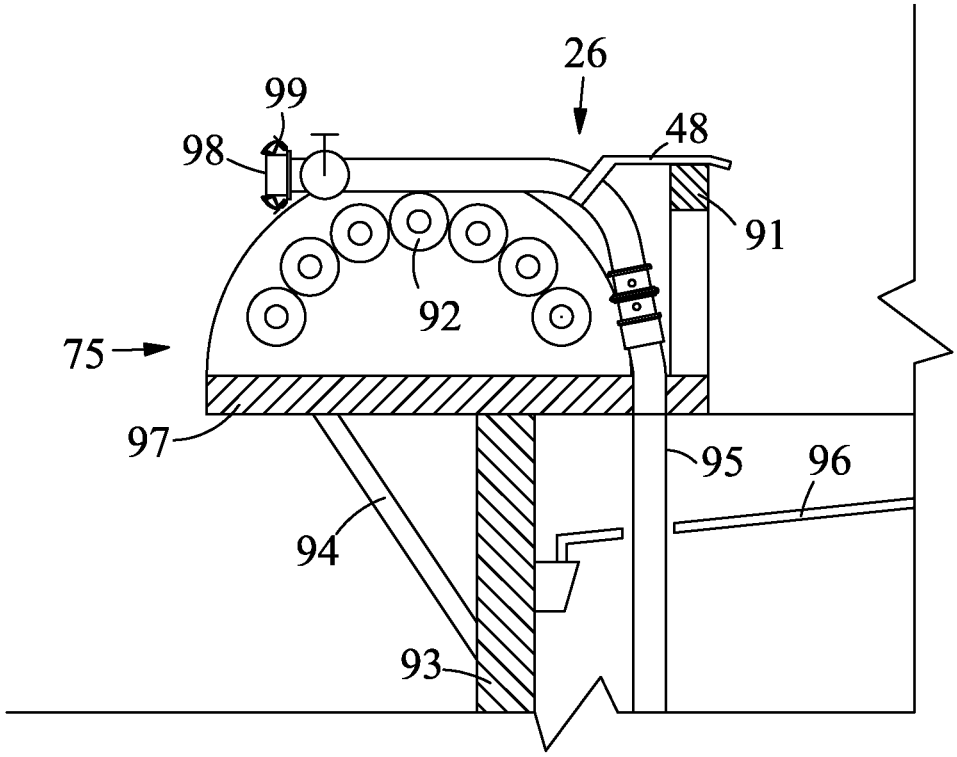
FIG. 9 is an enlarged view taken along 9-9 line in FIG. 7.

FIG. 9 shows details taken along line 9-9 in FIG. 7. The mobile end 26 sits on a storing seat that comprises a side bar 91 and a top roller bar 92 of the convex saddle 75. The convex saddle 75 is anchored to a shaft wall 93 at a bottom plate 97 along with a bracing strut 94. An external hose 95 goes through a hole on a roof 96 of the shaft. The mobile end 26 has an end flange 98 and a quick connecting/disconnecting (QC/DC) device 99.

Figure 10:
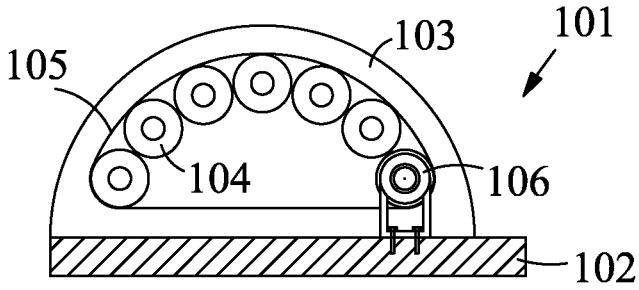
FIG. 10 is an elevation view of a convex saddle and motor.

FIG. 10 shows details of a convex saddle 101 which comprises two semicircle guides 103, and seven roller bars 104 in-between (refer also to 28 in FIG. 2). In this variation, a round belt 105 is wrapped around the roller bars 104, and driven by a motor 106 that is attached to a bottom roller bar and anchored to a base plate 102.

Figure 11:
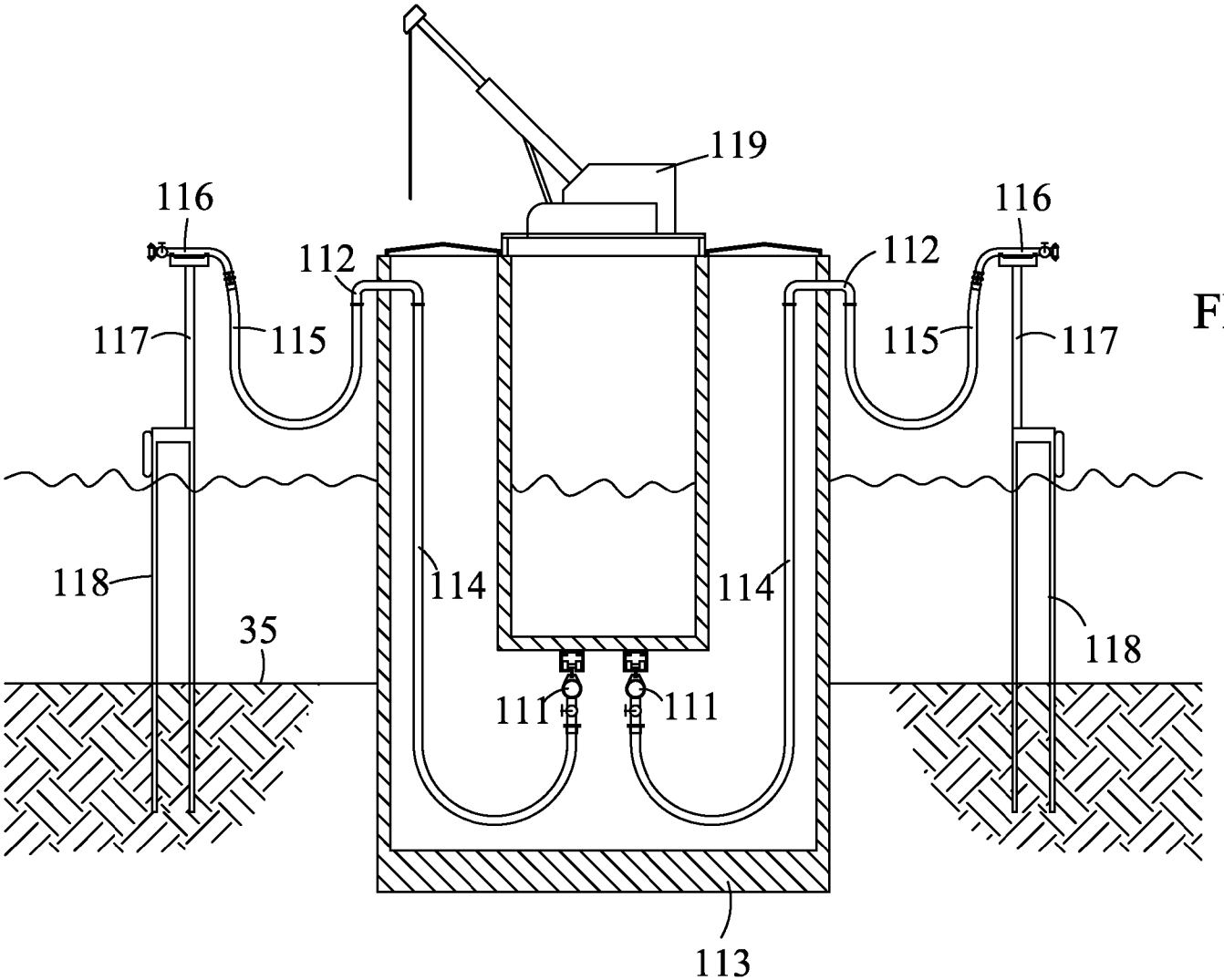
FIG. 11 is an elevation view of a fourth embodiment of present invention.

FIG. 11 shows a fourth embodiment of this invention intended for docking and loading two ships simultaneously. For simplicity, FIG. 11 shows both loading arms at a stored position on a storing seat 117. In this case, a shaft 113 is located offshore and a header 111 in inside the shaft 113 around the seabed 35. A n-shaped hose coupler 112 is hung on a wall of the shaft 113. An internal hose 114 extends from the header 111 to the hose coupler 112. Outside the shaft 113, an external hose 115 is freely hung from the hose coupler 112 at one end with a mobile end 116 on the storing seat 117. The storing seat 117 has two concave saddles at a distance 1.5 to 3 m apart on the top, and is mounted on piers of a dolphin 118. A strap can be used to secure the mobile end in the seat (not shown). Alternatively, the storing seat 117 can be supported on another structure such as a passageway, or be anchored directly into the seabed. A crane 119 is located at the top of the shaft 113.

Figure 12:
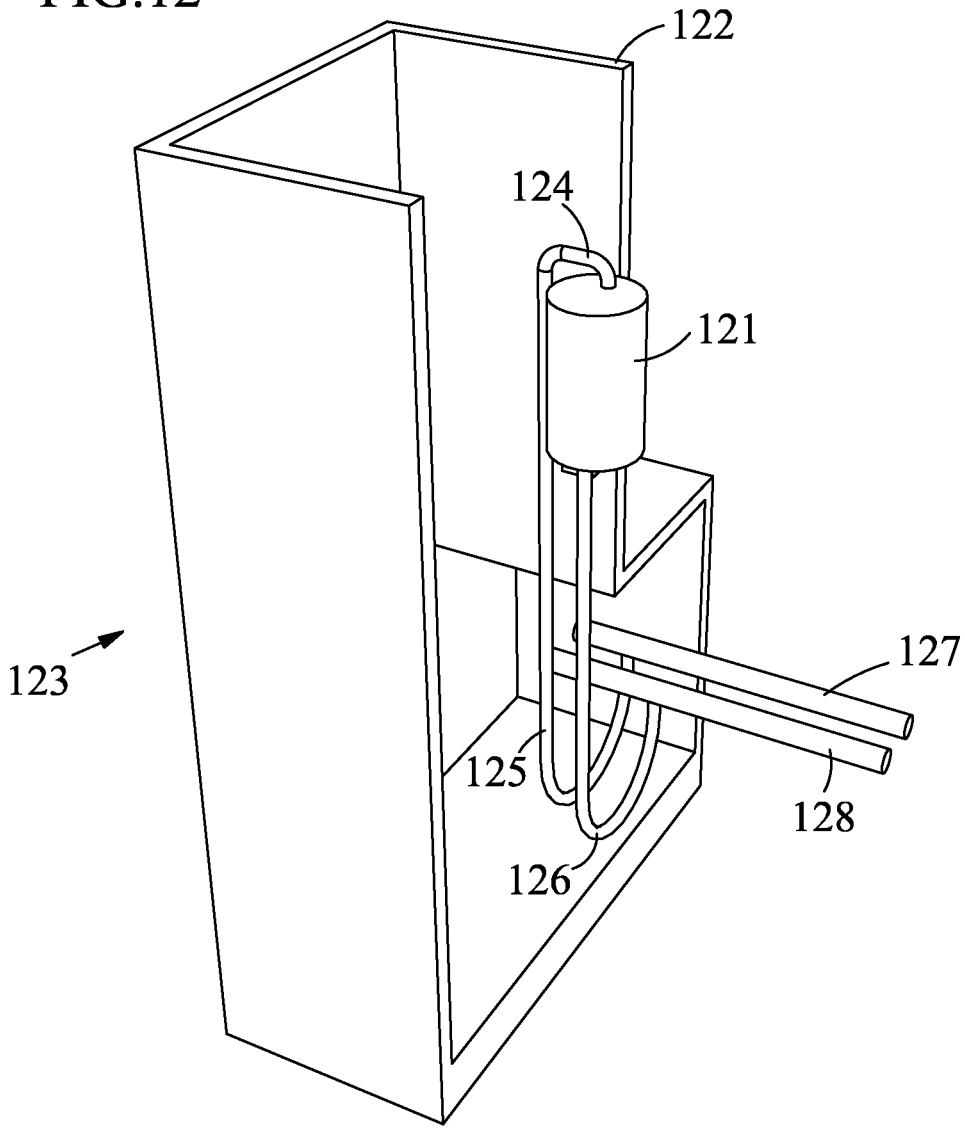
FIG. 12 is a perspective view of a surge drum and flexible connection with a transfer pipeline and a vapor return line.

FIG. 12 shows a surge drum 121 anchored to a wall 122 of a shaft 123. A gooseneck spool 124 is fluidly connected to the top of the drum 121. A vapor hose 125 extends from the gooseneck spool 124 to a vapor return line 127. A fluid hose 126 extends from the bottom of drum 121 to a transfer line 128. The drum 121 regulates any pressure surge.

Figure 13:
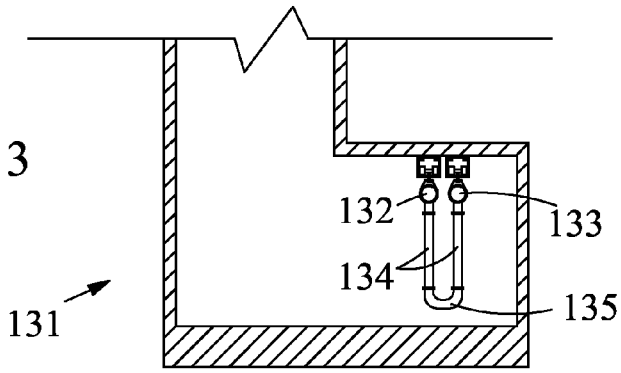
FIG. 13 is an elevation view of flexible connection between two transfer pipelines.

FIG. 13 shows flexible connection between two transfer pipelines. Inside a shaft 131, a first transfer pipeline 132 and second transfer pipeline 133 are fluidly connected with two flexible hoses 134 and a u-shaped coupler 135 at the bottom. Both the flexible hoses 134 and u-shaped coupler 135 are in a freely hanging position.

Figure 14A:
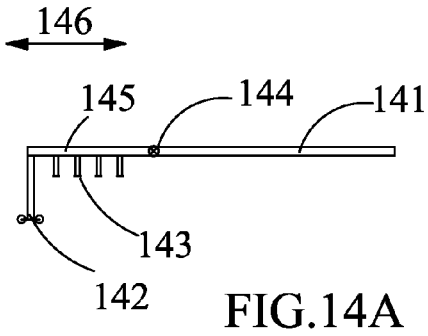
FIGS. 14A to 14D are simplified configurations at the free end of a transfer pipeline.
Figure 14B:
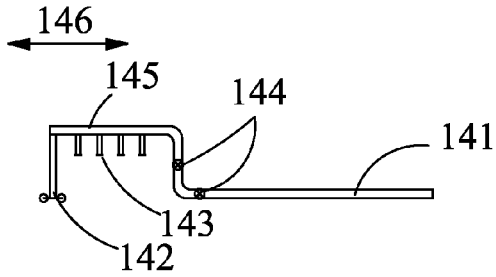
Figure 14C:
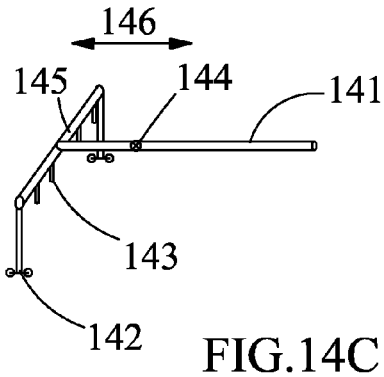
Figure 14D:
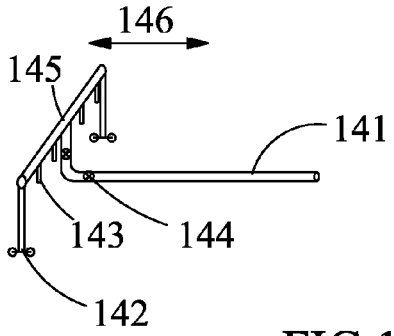

FIGS. 14A to 14D show variations around the free end of a transfer pipeline 141. In each configuration, there are a main valve 144 at the end of transfer pipeline 141, a header 145 and downward pipe branches 143 extended from header 145. At the ends of header 145, there are dollies 142 to support header 145 and to allow movements in the direction parallel to the axis of transfer pipeline 141 (i.e., in direction 146). In FIG. 14A, header 145 is in alignment with transfer pipeline 141. This configuration is preferred and has been used in all embodiments presented previously.

Figure 15:
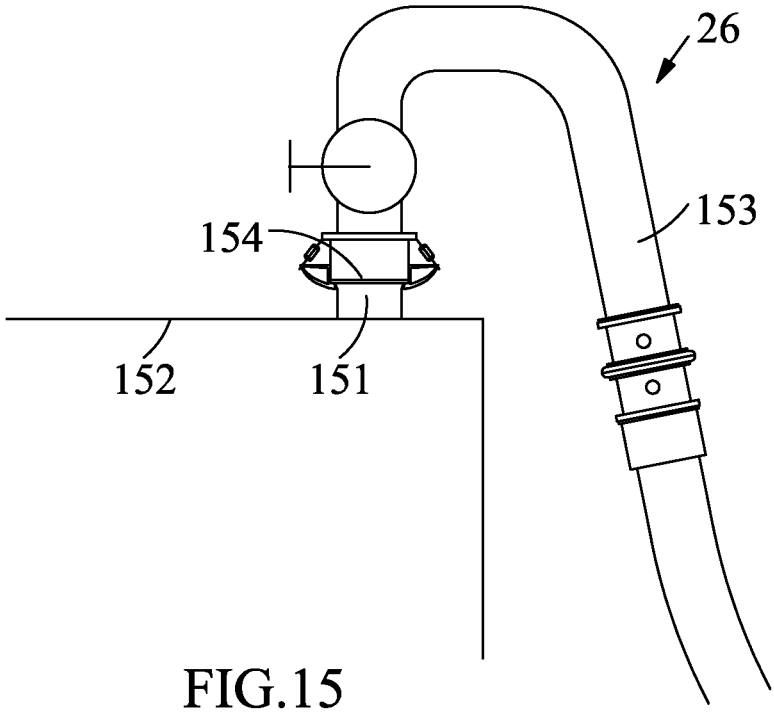
FIG. 15 is a variation of the mobile end of the loading arms according to the invention.

FIG. 15 shows a variation on the mobile end 26 of the loading arms. A presentation flange of a ship manifold 151 is facing up near the edge of a manifold platform 152. With an elbow spool 153 (i.e., gooseneck spool in this case), an end flange 154 is facing down.

I claim:

1. A loading system for transferring cryogenic fluids between storage tanks and a ship with at least one ship manifold on a manifold platform, said loading system comprising:

a) a shaft extending upwards to above the sea level;

b) at least one hose coupler with a first end and a second end, said first end is located inside said shaft and facing downward;

c) a transfer pipeline extended from said storage tanks to said shaft with a free end that is free to expand/contract axially inside said shaft;

d) a header fluidly connected to said free end of said transfer pipeline inside said shaft;

e) at least one downward pipe branch extended from said header inside said shaft;

f) at least one internal hose freely hung between said downward pipe branch and said first end of said hose coupler;

g) at least one loading arm with a connected end fluidly connected to said second end of said hose coupler and a mobile end that has an end flange for connection with said ship manifold and is movable to accommodate ship motions during fluid transfer;

h) at least one vertical support to support said header in the vertical direction;

wherein said header moves along with said free end of said transfer pipeline inside said shaft as said transfer pipeline expands and contracts.

2. The loading system of claim 1, wherein said vertical support is a pipe hanger.

3. The loading system of claim 1, wherein said loading arm is a flexible hose.

4. The loading system of claim 3 further comprising a convex saddle to support said flexible hose with a first portion inside said shaft and a second portion extended to said ship manifold for fluid transfer, wherein said second end of said hose coupler is located inside said shaft.

5. The loading system of claim 4, wherein said convex saddle comprising a group of roller bars.

6. The loading system of claim 5, wherein said convex saddle further comprises a belt that is wrapped around said roller bars and driven by a motor.

7. The loading system of claim 2, wherein said vertical support further comprising a metal track and a dolly, and said dolly ties said pipe hanger to said metal track.

8. The loading system of claim 1, wherein said loading arm further comprises an emergency release coupler (ERC).

9. The loading system of claim 1, wherein said loading arm further comprising a quick connecting and disconnecting device that can hold said end flange onto said ship manifold.

10. The loading system of claim 1, wherein said transfer position comprises a main leg that bears the weight of said mobile end.

11. The loading system of claim 10, wherein said main leg comprises a plate at the bottom, a column in the middle, a concave top, and two alignment guides.

12. The loading system of claim 11, wherein said concave top is formed with at least one roller.

13. The loading system of claim 11, wherein said concave top is a concave saddle.

14. The loading system of claim 1, wherein said second end of said hose coupler is located outside of said shaft.

15. The loading system of claim 1 further comprises a storing seat above the sea level and away from said ship to store said mobile end.

16. The loading system of claim 1 further comprises a surge drum inside said shaft with a hose freely hung between said surge drum and said transfer pipeline.

17. The loading system of claim 1 further comprises a second transfer pipeline and a hose freely hung between said two transfer pipelines.

18. The loading system of claim 1, wherein said loading arm further comprising an elbow spool.

19. The loading system of claim 18, wherein said elbow spool has a gooseneck shape with said end flange facing down.

20. The loading system of claim 1, wherein said mobile end further comprising an end valve near said end flange.

21. The loading system of claim 15 further comprising a crane that is used to lift said mobile end of said loading arm between a transfer position connected to said ship manifold and a storage position on said storing seat.

22. The loading system of claim 1, wherein said header is in alignment with said transfer pipeline.

23. A loading system for transferring cryogenic fluids between storage tanks and a ship with at least one ship manifold on a manifold platform, said loading system comprising:

a) a shaft extending upwards to above the sea level;

b) a transfer pipeline extended from said storage tanks to said shaft around the top with a free end that is free to expand/contract axially inside said shaft;

c) a header fluidly connected to said free end of said transfer pipeline inside said shaft;

d) at least one downward pipe branch extended from said header inside said shaft;

e) at least one internal hose with a first end and a second end, said first end freely hung under said downward pipe branch;

f) at least one loading arm with a connected end fluidly connected to said second end of said internal hose and a mobile end that has an end flange for connection with said ship manifold and is movable to accommodate ship motions during fluid transfer, and said loading arm is a flexible hose;

g) at least one convex saddle anchored at the top of said shaft to support said loading arm during fluid transfer;

h) at least one vertical support to support said header;

wherein said header is free to move along with said free end of said transfer pipeline.

24. The loading system of claim 23 further comprises at least one restraining device located below said convex saddle, wherein said restraining device restrains flanges at an end of said flexible hose from moving during fluid transfer.

25. The loading system of claim 23 further comprises a storing seat to store said mobile end at the top of said shaft with said hoses being kept inside said shaft.

26. The loading system of claim 25 further comprising a crane that is used to lift said mobile end of said loading arm between a transfer position connected to said ship manifold and a storage position on said storing seat.

27. A method for transfer cryogenic fluids between storage tanks and a ship with at least one ship manifold on a manifold platform, said method comprising:

a) building a shaft extended upwards to above the sea level;

b) extending a transfer pipeline from said storage tanks to said shaft with a free end that is free to expand/contract axially inside said shaft;

c) fluidly connecting a header to said free end of said transfer pipeline inside said shaft;

d) installing at least one downward pipe branch from said header inside said shaft;

e) freely hanging an internal hose with a first end and a second end, said first end of said internal hose is hung under said downward pipe branch;

f) extending a loading arm from said shaft to said ship with a connected end fluidly connected to said second end of said internal hose and a mobile end that has an end flange for connection with said ship manifold;

g) supporting said header in the vertical direction;

wherein said header is free to move along with said free end of said transfer pipeline.

28. The method in claim 27 further comprises lifting said mobile end of said loading arm to a storing seat stood away from said ship when fluid transfer is over.

29. The method in claim 27 further comprises attaching a hose coupler to said shaft to tie-in said internal hose and said loading arm.

30. The method in claim 27 further comprises installing a convex saddle on the top of said shaft to support said loading arm during fluid transfer, wherein said loading arm is a flexible hose.

* * * * *